US009926153B2

(12) United States Patent
Kubota et al.

(10) Patent No.: US 9,926,153 B2
(45) Date of Patent: Mar. 27, 2018

(54) SHEET ALIGNING APPARATUS, IMAGE FORMING SYSTEM AND SHEET POST-PROCESSING APPARATUS

(71) Applicants: Yuichi Kubota, Yamanashi-ken (JP); Tatsuya Ohmori, Yamanashi-ken (JP); Masashi Yamashita, Yamanashi-ken (JP)

(72) Inventors: Yuichi Kubota, Yamanashi-ken (JP); Tatsuya Ohmori, Yamanashi-ken (JP); Masashi Yamashita, Yamanashi-ken (JP)

(73) Assignee: CANON FINETECH NISCA INC., Misato-shi, Saitama (JP)

( * ) Notice: Subject to any disclaimer, the term of this patent is extended or adjusted under 35 U.S.C. 154(b) by 0 days.

(21) Appl. No.: 15/363,479

(22) Filed: Nov. 29, 2016

(65) Prior Publication Data

US 2017/0152118 A1 Jun. 1, 2017

(30) Foreign Application Priority Data

Nov. 30, 2015 (JP) ..... 2015-233319

(51) Int. Cl.
*B65H 31/34* (2006.01)
*B65H 7/02* (2006.01)
(Continued)

(52) U.S. Cl.
CPC ..... *B65H 7/02* (2013.01); *B65H 9/101* (2013.01); *B65H 31/02* (2013.01); *B65H 31/3027* (2013.01); *B65H 31/36* (2013.01); *B65H 31/38* (2013.01); *B65H 43/04* (2013.01); *B65H 2301/4212* (2013.01); *B65H 2301/4213* (2013.01); *B65H 2405/1134* (2013.01); *B65H 2511/242* (2013.01); *B65H 2511/51* (2013.01);
(Continued)

(58) Field of Classification Search
CPC ..... B65H 31/34; B65H 31/38; B65H 43/00; B65H 43/04; B65H 2553/23; B65H 2553/232; B65H 2801/27
See application file for complete search history.

(56) References Cited

U.S. PATENT DOCUMENTS 6,388,452 B1 * 5/2002 Picciotto ..... B41J 11/0035 324/452
9,359,163 B1 * 6/2016 Miyazaki ..... B65H 31/38
(Continued)

FOREIGN PATENT DOCUMENTS

JP 4880575 B2 2/2012
JP 5288377 B2 9/2013

*Primary Examiner* — David H Bollinger
(74) *Attorney, Agent, or Firm* — Manabu Kanesaka

(57) ABSTRACT

The present invention is to provide a sheet aligning apparatus that is capable of detecting misalignment. A control portion of a post-processing apparatus causes a front aligning member and a rear aligning member to be moved to an aligning position to align sheets conveyed to a processing tray, causes the front aligning member to be moved from the aligning position to a detecting position, and determines whether an electrostatic capacitance sensor detects misalignment (sheet shifting from a sheet bundle). When it is determined that the sensor detects misalignment, the front aligning member is moved from the detecting position to the aligning position so that sheets are realigned.

13 Claims, 8 Drawing Sheets

(51) Int. Cl.

| | |
|---|---|
| ***B65H 9/10*** | (2006.01) |
| ***B65H 31/02*** | (2006.01) |
| ***B65H 31/30*** | (2006.01) |
| ***B65H 31/36*** | (2006.01) |
| ***B65H 31/38*** | (2006.01) |
| ***B65H 43/04*** | (2006.01) |

(52) U.S. Cl.
CPC .. *B65H 2515/712* (2013.01); *B65H 2553/232* (2013.01); *B65H 2553/81* (2013.01); *B65H 2553/822* (2013.01); *B65H 2553/83* (2013.01); *B65H 2701/1315* (2013.01); *B65H 2801/27* (2013.01)

(56) References Cited

U.S. PATENT DOCUMENTS

| | | | | |
|---|---|---|---|---|
| 2012/0025442 | A1* | 2/2012 | Naraoka | B42B 4/00 270/58.12 |
| 2015/0023765 | A1* | 1/2015 | Hongu | B65H 43/06 412/33 |
| 2015/0183606 | A1* | 7/2015 | Nishi | B65H 31/02 271/234 |
| 2015/0225200 | A1* | 8/2015 | Yamashita | B65H 37/04 270/58.12 |
| 2015/0284203 | A1* | 10/2015 | Terrero | B65H 9/101 271/228 |

* cited by examiner

SHEET ALIGNING APPARATUS, IMAGE FORMING SYSTEM AND SHEET POST-PROCESSING APPARATUS

BACKGROUND OF THE INVENTION

Technical Field

The present invention relates to a sheet aligning apparatus, an image forming system, and a sheet post-processing apparatus, and in particular, relates to a sheet aligning apparatus that aligns sheets conveyed to a sheet stack portion while pushing the sheet in a direction perpendicular to a sheet conveying direction, an image forming system including an image forming portion that forms an image on a sheet and the sheet aligning apparatus, and a sheet post-processing apparatus including the sheet aligning apparatus and a post-processing portion that performs a post-process on a sheet or a sheet bundle.

Description of the Related Art

Conventionally, in the field of image forming systems, there have been widely known sheet aligning apparatuses for aligning image-formed sheets and forming sheet bundles as preprocessing for performing post-processes such as stapling processes or as preference of operators. In general, such a sheet aligning apparatus includes a sheet stack portion on which sheets are stacked, an aligning member that aligns sheets conveyed to the sheet stack portion by pushing the sheets in a direction perpendicular to a sheet conveying direction, and a moving device that moves the aligning member between an aligning position and a non-aligning position.

A processing tray or the like other than a stack tray on which sheets (sheet bundles) are discharged accordingly is often adopted as the sheet stack portion. Further, an aligning plate that aligns sheets stacked on the sheet stack portion by pushing the sheets in a width direction is often adopted as the aligning member. Such an aligning member is configured to be movable between an aligning position and a non-aligning position with a moving device that includes a drive source such as a motor, and a drive force transmitting portion such as a gear, a pulley, and a belt.

Examples of a sheet aligning apparatus described above include a sheet post-processing apparatus in which aligning control is varied in accordance with the number of sheets conveyed to the sheet stack portion (processing tray) as disclosed in Japanese Patent No. 4880575 and a sheet post-processing apparatus in which an aligning process is varied under conditions of sheet basis weight (sheet weight (grams) per square meter) and sheet size difference as disclosed in Japanese Patent No. 5288377.

SUMMARY OF THE INVENTION

In a practical sense, when an aligning process is performed, there may be a case that sheet aligning characteristics is deteriorated (a case that sheets are misaligned) irrespective of the number of sheets stacked on the sheet stack portion under the influence of a stick state among sheets due to static electricity, air layers among sheets, and the like. Further, since sheet characteristics vary depending on manufacturers even with the same basic weight, aligning characteristics vary even with aligning control under the same conditions.

To solve the abovementioned problems, there have been apparatuses in which control is performed under conditions that are set in detail. However, in this case, a number of input instructions including kind and size of sheets, an operating mode, the number of stacked sheets, and the like are required, resulting in burden to operators. Further, regardless of the above, it is unclear until a post-processed sheet bundle is discharged to the abovementioned stack tray whether or not the sheet bundle has been reliably aligned.

In view of the above, a first object of the present invention is to provide a sheet aligning apparatus, an image forming system, and a sheet post-processing apparatus capable of detecting misalignment. Further, a second object of the present invention is to provide a sheet aligning apparatus, an image forming system, and a sheet post-processing apparatus capable of correcting the detected misalignment.

To achieve the first object, a first aspect of the present invention provides a sheet aligning apparatus including a sheet stack portion on which a sheet is to be stacked, an aligning member that is configured to press a sheet conveyed to the sheet stack portion in a direction perpendicular to a sheet conveying direction and to align the sheet at an aligning position, a moving device that is configured to move the aligning member between the aligning position and a non-aligning position, and a detecting device that is configured to detect shifting of a sheet from a sheet bundle aligned at the aligning position as misalignment.

In the first aspect, for aligning the sheet conveyed to the sheet stack portion, the sheet aligning apparatus includes the aligning member that is configured to press a sheet conveyed to the sheet stack portion in a direction perpendicular to the sheet conveying direction and to align the sheet at the aligning position, and the moving device that is configured to move the aligning member between the aligning position and the non-aligning position. Here, sheet shifting from a sheet bundle aligned at the aligning position is detected by the detecting device as misalignment. Further, to achieve the second object, in the first aspect, the sheet aligning apparatus may further include a control portion that is configured to control the moving device so that the aligning member is located at the aligning position when the misalignment is detected by the detecting device. In this case, when misalignment is detected by the detecting device, the moving device is controlled by the control portion so that the aligning member is located at the aligning position.

In the first and second aspects, it is also possible that the detecting device is configured to be moved along with the aligning member. Further, the moving device may be configured to move the aligning member between the aligning position and a detecting position where the misalignment is to be detected, and the detecting device may be configured to detect the misalignment when the aligning member is located at the detecting position.

Further, the aligning member may be structured with a pair of members arranged at both sides of a direction perpendicular to the sheet conveying direction as sandwiching a conveyed sheet, and the detecting device may be arranged at at least one of the members. Here, the detecting device may be an electrostatic capacitance sensor, and at least an electrode member of the electrostatic capacitance sensor may be arranged at at least one of the members.

Further, the control portion may control the moving device so as to cause the aligning member to be moved to the aligning position and align a sheet conveyed to the sheet stack portion, and then, to cause the aligning member to be moved from the aligning position to the detecting position; and the control portion may control the moving device so as to cause, when the detecting device detects the misalignment, the aligning member to be moved from the detecting position to the aligning position and realign the sheet, and then, to cause the aligning member to be moved from the aligning position to the detecting position to repeat detecting the misalignment by the detecting device.

Further, to achieve the first object, a second aspect of the present invention provides an image forming system including an image forming portion configured to form an image on a sheet, and the sheet aligning apparatus of the first aspect. Here, to achieve the second object, in the second aspect, the image forming apparatus may further include a control portion that is configured to control the moving device so that the aligning member is located at the aligning position when the misalignment is detected by the detecting device. Further, a third aspect of the present invention provides a sheet post-processing apparatus including the sheet aligning apparatus of the first aspect. To achieve the second object, in the third aspect, the sheet post-processing apparatus may further include a control portion that is configured to control the moving device so that the aligning member is located at the aligning position when the misalignment is detected by the detecting device, and a post-processing portion that is configured to perform a post-process on a sheet or a sheet bundle.

According to the present invention, since sheet shifting from a sheet bundle aligned at the aligning position is detected by the detecting device, it is possible to acknowledge occurrence of misalignment.

BRIEF DESCRIPTION OF THE DRAWINGS

FIGS. 4A to 4C are explanatory views of the aligning mechanism, while FIG. 4A is a bottom view viewing the aligning mechanism of FIG. 3 viewing from the back face side, FIG. 4B is a plane view schematically illustrating each position to which a front aligning member of the aligning mechanism is positioned, and FIG. 4C is a side view schematically illustrating each position to which the front aligning member is positioned;

DETAILED DESCRIPTION OF THE PREFERRED EMBODIMENT

Figure 1:
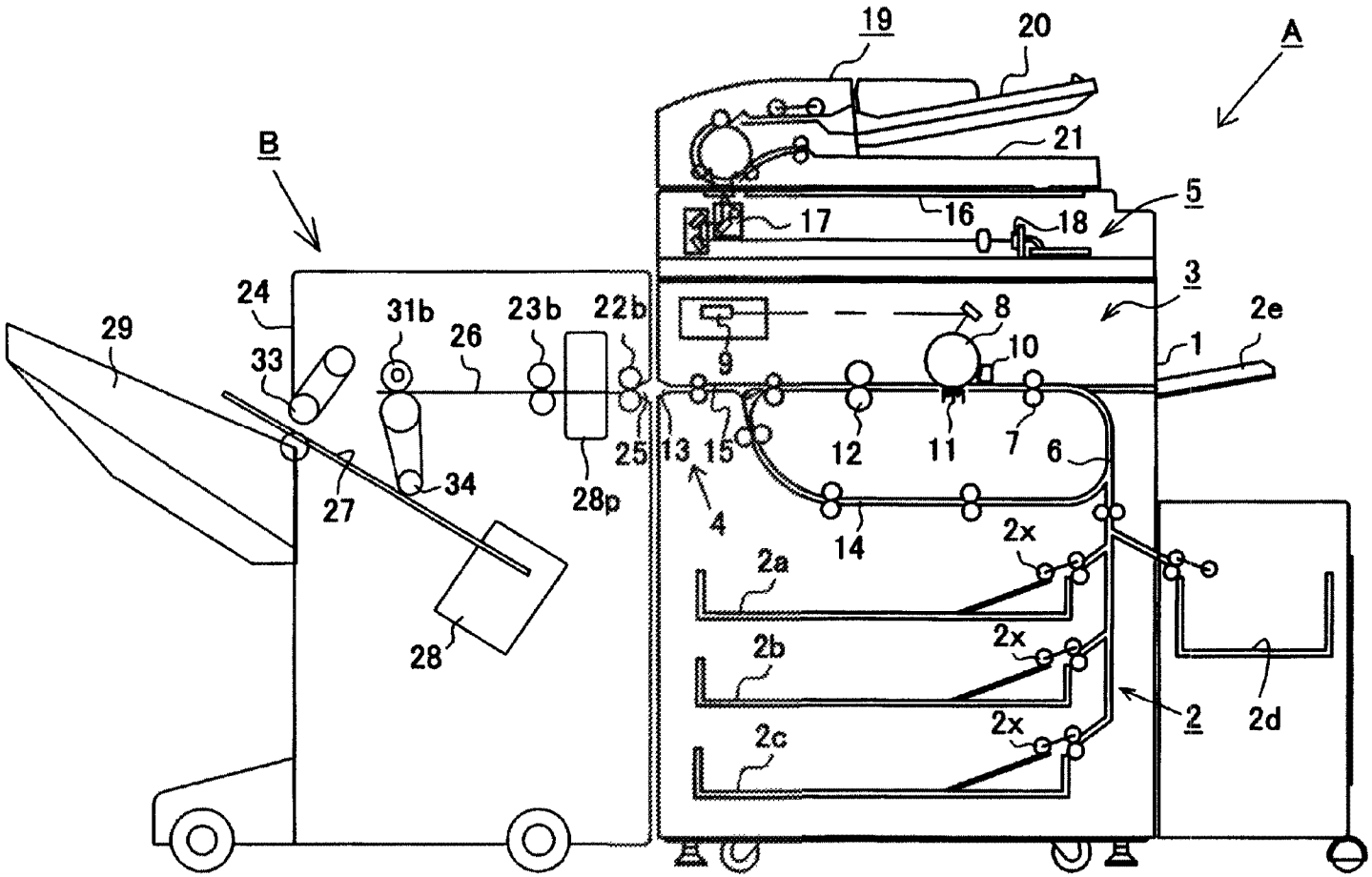
FIG. 1 is a front view of an image forming system of an embodiment to which the present invention is applicable.

In the following, embodiments obtained by applying the present invention to an image forming system will be described with reference to the attached drawings. FIG. 1 illustrates an image forming system of the present embodiment structured with an image forming apparatus A and a post-processing apparatus B. In the illustrated structure, the image forming apparatus A forms an image on a sheet and discharges the sheet through a sheet discharging port 13. The sheet discharging port 13 is connected to an introducing port 25 of the post-processing apparatus B, so that the image-formed sheet is introduced into the post-processing apparatus B.

A sheet conveying path 26 for conveying sheets and a processing tray 27 on which sheets are to be stacked are arranged in the post-processing apparatus B. Image-formed sheets are stacked on a sheet placement face of the processing tray 27 through the sheet conveying path 26. The processing tray 27 is provided with an aligning mechanism 60 (see FIG. 2) that aligns sheets.

A post-processing unit 28 (stapling unit) that performs a post-process on the sheets aligned by the aligning mechanism 60 is arranged on one side of the processing tray 27 to bind the stacked sheets into a bundle shape. A stack tray 29 is arranged at the downstream side of the processing tray 27 to store the post-processed sheet bundle thereon. In the following, description will be provided on the image forming system of the present embodiment in the order of the image forming apparatus A and the post-processing apparatus B.

(Configuration)

[Image Forming Apparatus A]

<Mechanical Section>

As illustrated in FIG. 1, the image forming apparatus A includes a sheet feeding portion 2, an image forming portion 3, and a sheet discharging portion 4 in a housing 1. Further, an image reading portion 5 and a document feeding apparatus (ADF) 19 are arranged above the housing 1 as optional units. The housing 1 is arranged as an external casing having an appropriate shape for an on-floor installation type (stand-alone type), a desk-top type, or the like.

The sheet feeding portion 2 includes a plurality of sheet feeding cassettes 2*a*, 2*b*, 2*c* (hereinafter, collectively called the feeding cassette 2*a*) that store sheets of different sizes, a high-capacity cassette 2*d* that stores generally-used sheets in large quantity, and a manual sheet feeding tray 2*e*. The sheet feeding cassette 2*a* can adopt any of various structures. In FIG. 1, the sheet feeding cassette 2*a* incorporates a sheet placement base on which sheets are stored, a pick-up roller 2*x* that feeds a sheet on the sheet placement base, and a separating unit (a separating pawl, a retard member, or the like) that separates sheets one by one. Each of the cassettes 2*a* to 2*c* is mounted on the housing 1 in a detachably attachable manner.

The high-capacity cassette 2*d* is a sheet feeding unit that stores sheets to be consumed in large quantity as being mounted in the housing 1 or outside the housing as an option. The manual sheet feeding tray 2*e* feeds, in accordance with image forming timing of the image forming portion 3, sheets that are not required to be stored in a cassette or sheets that cannot be stored in a cassette such as thick sheets and specially coated sheets.

The number of the sheet feeding cassettes 2*a*, necessity of the high-capacity cassette 2*d*, and necessity of the manual sheet feeding tray 2*e* are freely selectable in accordance with apparatus specifications. In FIG. 1, the sheet feeding portion 2 includes at least two different sheet feeding mechanisms. The sheet feeding mechanisms may be structured, for example, as a combination of the first sheet feeding cassette 2*a* and the second sheet feeding cassette 2*b*, or a combination of the sheet feeding cassette 2*a* and the high-capacity sheet feeding cassette 2*d*.

A sheet feeding path 6 is arranged at the downstream side of the sheet feeding portion 2 to feed a sheet fed from the sheet feeding cassette 2*a* to the image forming portion 3 at the downstream side. The sheet feeding path 6 is provided with a conveying mechanism (conveying roller or the like)

to convey a sheet and a resist roller 7 located just before the image forming portion 3. The resist roller 7 includes a pair of rollers pressure-contacted to each other, so that sheet leading end aligning (skew correcting) is performed while a sheet is curved into a loop shape with a leading end thereof abutted to the rollers in a stopped state.

As illustrated in FIG. 1, the resist roller 7 is arranged at an end part of the sheet feeding path 6 and a resist area is arranged at a path guide to curve a sheet into a loop shape. Thus, the leading end of the sheet fed from each of the sheet feeding cassettes 2*a* is aligned by the resist roller 7 and the sheet is kept waiting at the position for the timing of image forming.

The image forming portion 3 can adopt an image forming mechanism such as an ink jet printing mechanism, a silk screen printing mechanism, an offset printing mechanism, and an ink ribbon printing mechanism. The image forming portion 3 in FIG. 1 adopts an electrostatic image forming mechanism. A print-head 9 (laser light emitting device) and a developing device 10 are arranged around a photosensitive drum 8. A surface of the photosensitive drum is formed of photoreceptor to have different electrostatic characteristics in accordance with light. A latent image is formed on the surface by the print-head 9 and toner ink adheres thereto with the developing device 10. Concurrently, the sheet waiting at the resist roller 7 is fed toward the circumferential surface of the photosensitive drum 8 and a toner image is transferred onto the sheet by a charger 11. The toner image is fixed by a fixing device 12 and the sheet is conveyed to the sheet discharging portion 4.

The sheet discharging portion 4 includes a sheet discharging path 15 that guides the sheet having an image formed by the image forming portion 3 to a sheet discharging port 13 formed at the housing 1. A duplex path 14 is arranged at the sheet discharging portion 4, so that the sheet having an image formed on the front face thereof is guided again to the resist roller 7 after being face-reversed. Then, after an image is formed on the back face of the sheet by the image forming portion 3, the sheet is guided to the sheet discharging port 13 from the sheet discharging path 15. The duplex path 14 includes a switchback path to invert the conveying direction of the sheet fed from the image forming portion 3 and a U-turn path to face-reverse the sheet. In FIG. 1, the switchback path includes the sheet discharging path 15 and the sheet conveying path 26 of the post-processing apparatus B.

The image reading portion 5 in FIG. 1 includes a reading platen 16, a reading carriage 17 that reciprocates along the reading platen 16, and a photoelectric conversion element 18. A light source lamp (not illustrated) is built in the reading carriage 17 so that a sheet document set on the platen 16 is irradiated with reading light. Reflection light from the document is concentrated on the photoelectric conversion element through a collecting lens. With such a structure, the document set on the reading platen 16 is scanned by the carriage 17 and converted into electric signals by the photoelectric element 18. The electric signals are sent to a later-mentioned image forming control portion 42 (see FIG. 7) as image data.

A document feeding device 19 is installed on the image forming apparatus A. The document feeding device 19 separates documents set on the sheet feeding tray 20 one by one and guides to the reading platen 16. The document image-read at the reading platen 16 is stored on a sheet discharging tray 21. The image forming apparatus A includes a touch panel (not illustrated) by which a sheet size an operator desires, a sheet feeding cassette for feeding, and image forming in color or black-and-white can be specified (input) while statuses and the like of the image forming apparatus A are displayed.

<Controlling Section>

Further, the image forming apparatus A includes a control portion 40 (hereinafter, called a main-body control portion to be discriminated from a later-mentioned control portion of the post-processing apparatus B) that performs whole control of the image forming apparatus A and communicates with the control portion of the post-processing apparatus B.

Figure 7:
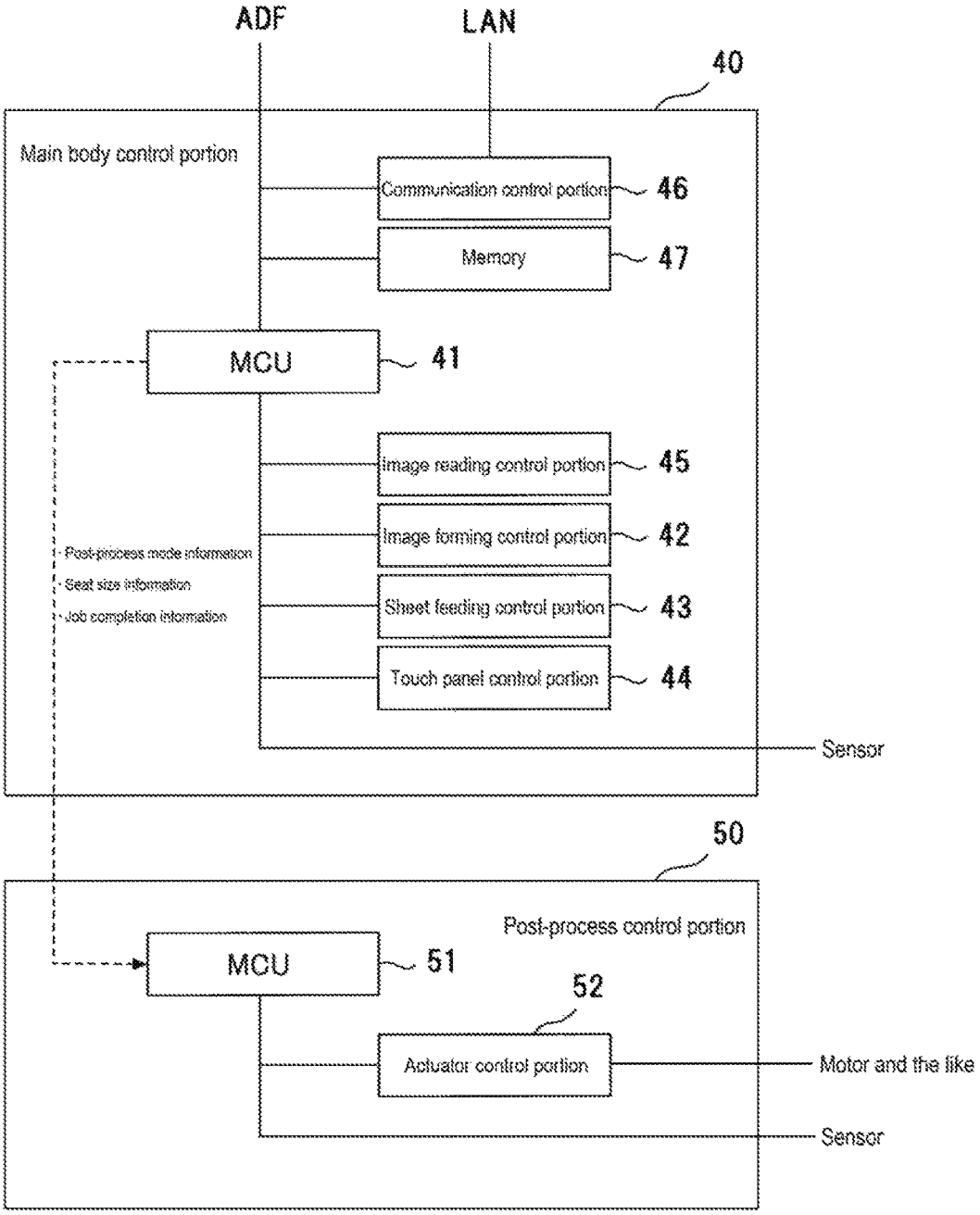
FIG. 7 is a block diagram of a control portion of the image forming system.

As illustrated in FIG. 7, the main-body control portion 40 includes an MCU 41 that incorporates a CPU, a ROM, a RAM, and the like. The MCU 41 is connected to an image reading control portion 45 that controls operation of the image reading portion 5, the image forming control portion 42 that controls operation of the image forming portion 3, a sheet feeding control portion 43 that controls operation of the sheet feeding portion 2, and a touch panel control portion 44 that controls the above-mentioned touch panel.

Further, the MCU 41 is connected to a plurality of (sensor control portions of) sensors that are arranged at the sheet feeding path 6, the duplex path 14, the sheet discharging path 15, and the like. Furthermore, the MCU 41 is connected to a communication control portion 46 that enables LAN connection, and a high-capacity memory 47 that functions as a buffer, as well as the abovementioned document feeding device 19 through an interface (not illustrated).

[Post-Processing Apparatus]

The post-processing apparatus B is arranged as being continuously connected to the image forming apparatus A to be connected to the sheet discharging port 13. Description will be provided on the post-processing apparatus B with reference to FIG. 2. The post-processing apparatus B includes, in a casing 24, the sheet conveying path 26 that includes the introducing port 25 and a sheet discharging port 30 arranged at the casing 24, the processing tray 27 that temporarily stores sheets (causes sheets to be stacked thereon) fed through the conveying path 26 for the post-processing, a reversing roller 33 and a friction rotor 34 that assists stacking of sheets on the processing tray 27, the aligning mechanism 60 that aligns sheets conveyed on the processing tray 27, the post-processing unit 28 arranged on one side of the processing tray 27, and the stack tray 29 on which post-processed sheets are stacked.

<Sheet Conveying Path>

The sheet conveying path 26 is formed by a gap between guide members that guide a sheet. The sheet conveying path 26 forms an approximately linear path arranged in the casing 24 in the horizontal direction. The introducing port 25 is arranged at a position to be connected to the discharging port 13 of the image forming apparatus A.

A punch unit 28*p* that punches file holes in a fed sheet is arranged at the sheet conveying path 26 on the downstream side of an introducing roller 22. A plurality of conveying rollers are arranged at the sheet conveying path 26 to convey a sheet from the introducing port 25 toward the sheet discharging port 30. That is, the introducing roller 22 is arranged at the introducing port 25, the conveying roller 23 is arranged at the downstream side of the punch unit 28*p* in the sheet conveying direction, and a sheet discharging roller 31 is arranged in the vicinity of the sheet discharging port 30. Among these rollers, rollers 22*a*, 23*a*, 31*a* arranged at the lower side are driving rollers to which rotational drive force is transmitted from a conveying motor (not illustrated) through gears and rollers 22*b*, 23*b*, 31*b* arranged at the upper side are driven rollers.

A first sensor Se1 that detects a sheet being conveyed to be introduced to the post-processing apparatus B is arranged at the downstream side of the introducing roller 22 and the upstream side of the punch unit 28*p*. A second sensor Se2 that detects a sheet being conveyed (to the processing tray 27) to be discharged from the sheet conveying path 26 is arranged in the vicinity of the sheet discharging port 30 (at the upstream side of the sheet discharging roller 31). In the present embodiment, optical sensors each having a light emitting element and a light receiving element are used as the sensors Se1, Se2. However, instead of the above, it is also possible to use electrostatic capacitance sensors described later.

<Processing Tray>

The processing tray 27 is shaped to have a slope being downward to the right toward the post-processing unit 28 with respect to the sheet conveying path 26 that is arranged in the horizontal direction. Further, the processing tray 27 is arranged to bridge-support a sheet with the stack tray 29 that is arranged at the downstream side. That is, the stack tray 29 supports a leading end side of a sheet fed through the sheet discharging port 30 (to be exact, the uppermost stacked sheet) and the processing tray 27 supports a tailing end side thereof.

Figure 3:
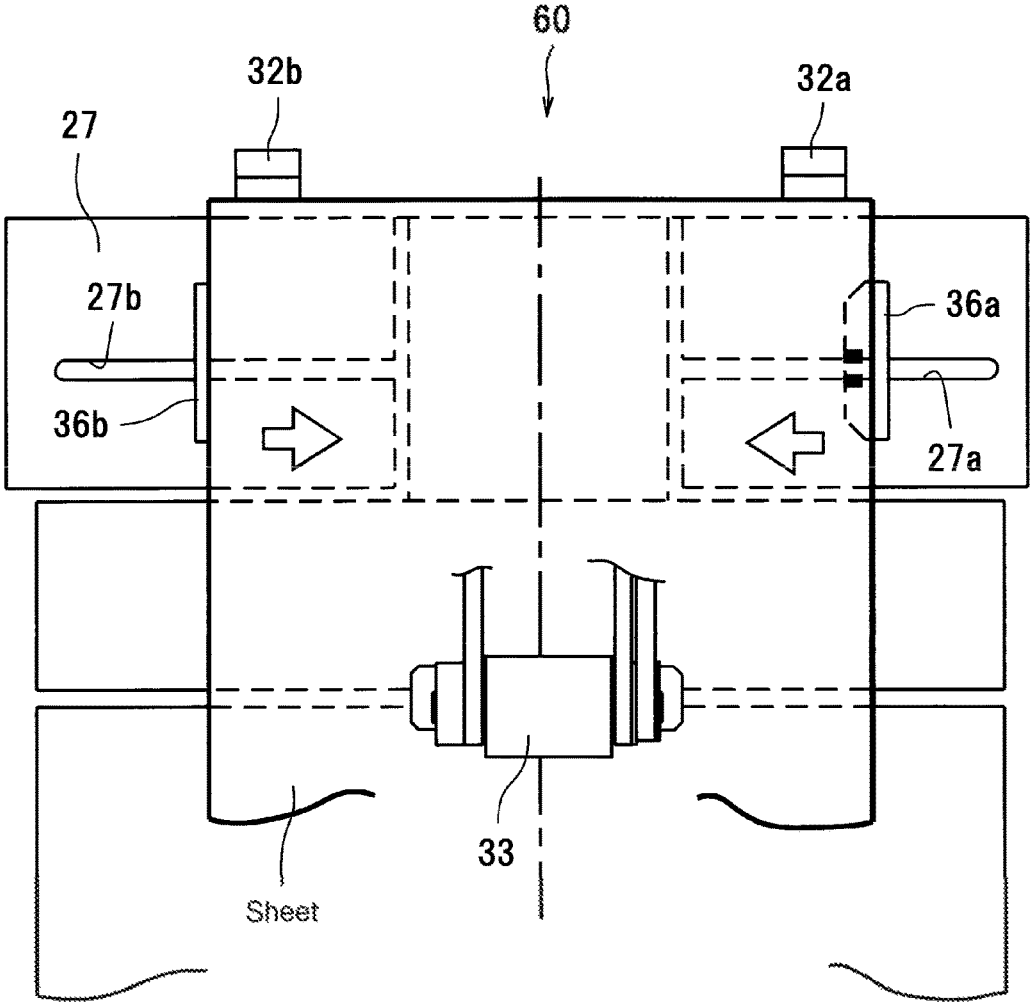
FIG. 3 is a plane view of a processing tray and an aligning mechanism that structure the post-processing apparatus.

The processing tray 27 is formed of a resin-made plate-shaped member that is divided into pieces. As illustrated in FIG. 3, the processing tray 27 is divided into three pieces on the post-processing unit 28 side (i.e., on the upper side in FIG. 3). Hereinafter, for descriptive purposes, the plate-shaped member divided into three pieces is called a front tray, a center tray, and a rear tray from the right side to the left side in FIG. 3. Here, the front tray and the rear tray are arranged in a symmetrical manner with each other with respect to the center line of the center tray (a dot-and-dash line in FIG. 3).

Linear guide grooves 27*a*, 27*b* are formed in a direction perpendicular to the sheet conveying direction from an end part on the center tray side respectively at the center parts of the front tray and rear tray. Here, it is also possible that the front tray, the center tray, and the rear tray are arranged as a single plate-shaped member. In the present embodiment, the structure of being divided into three pieces is adopted to improve easiness and accuracy of processing the guide members 27*a*, 27*b* and achieve common use of the front tray and the rear tray.

<Reversing Roller and Friction Rotor>

Figure 2:
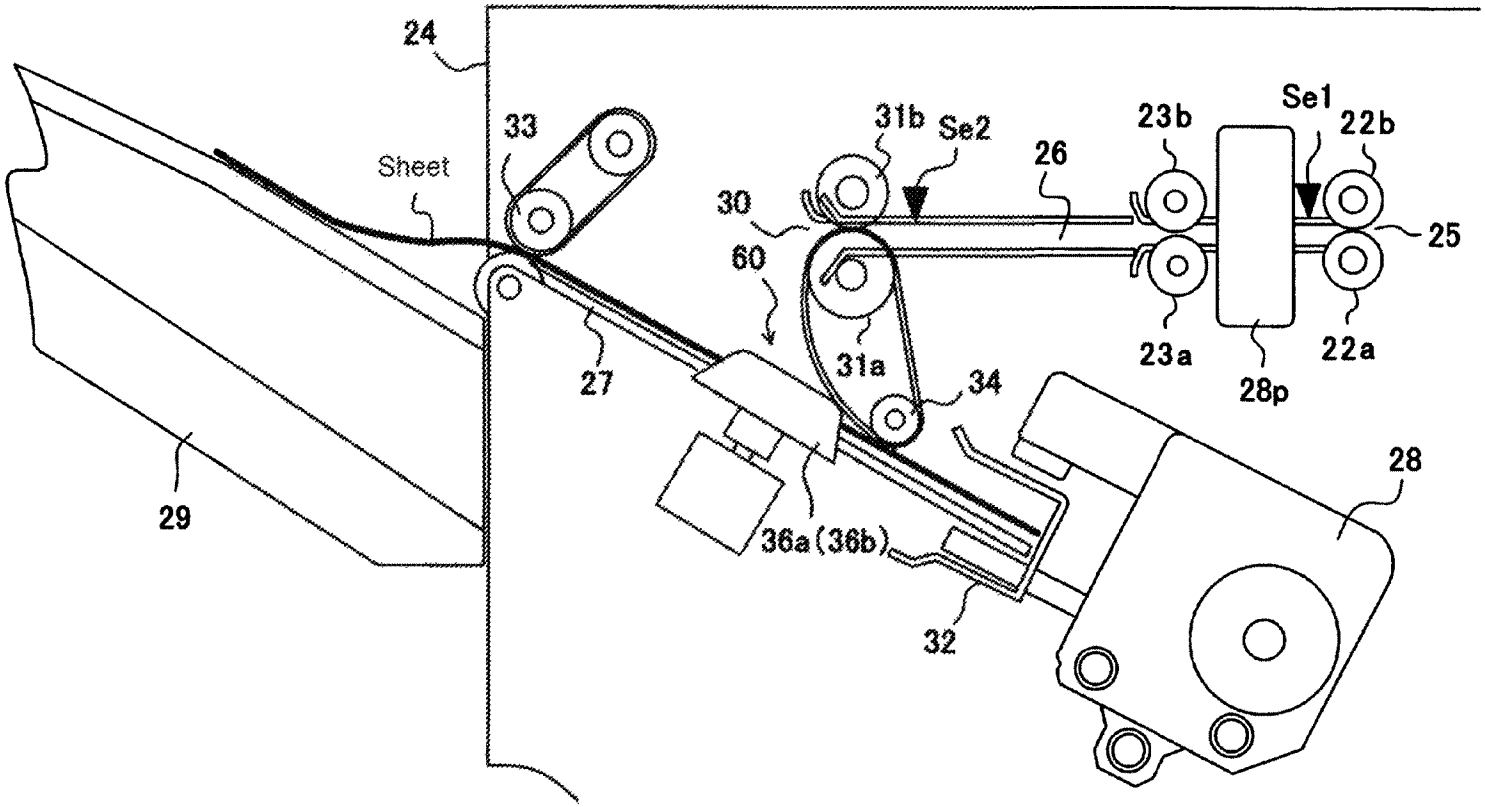
FIG. 2 is a front view of a post-processing apparatus in the image forming system of the present embodiment.

As illustrated in FIG. 2, a step is formed between the sheet discharging port 30 and the processing tray 27. A sheet is stacked while a sheet leading end is fed through the sheet discharging port 30 on the uppermost sheet on the processing tray 27 and a sheet tailing end is dropped through the sheet discharging port 30. The reversing roller 33 (positive-reverse roller) and the friction rotor 34 are arranged to support sheet stacking on the processing tray 27.

The reversing roller 33 has a function to convey a sheet fed through the sheet discharging port 30 to the downstream side (to the right side in FIG. 2) and a function to convey the sheet toward a regulating member 32 (described later in detail) after the tailing end of the sheet drops on the processing tray 27 through the sheet discharging port 30. The reversing roller 33 is connected to a drive motor (not illustrated) capable of providing positive-reverse rotation and is supported by an apparatus frame to be capable of being lifted and lowered between awaiting position above the processing tray 27 and an operating position on the processing tray 27. The upward and downward motion between the waiting position and the operating position is caused by a lifting-lowering motor (not illustrated).

The reversing roller 33 is located at the waiting position at the above until a leading end of the sheet enters onto the processing tray 27 through the sheet discharging port 30. After the leading end of the sheet reaches the position of the reversing roller 33, the reversing roller 33 is lowered onto the sheet and is rotated in the sheet discharging direction to convey the sheet in a direction toward the stack tray 29. Then, after a tailing end of the sheet is dropped on the processing tray 27 through the sheet discharging port 30, the reversing roller 33 is rotated in a direction opposite to the sheet discharging direction (in the counterclockwise direction in FIG. 2). Subsequently, after the tailing end of the sheet is raked by the friction rotor 34, the reversing roller 33 is lifted from the operating position to be engaged with a sheet to the waiting position and stands by thereat. Rotation of the reversing roller 33 is stopped before and after the above operation.

Meanwhile, the friction rotor 34 is structured with a rotor to rake the tailing end of the sheet dropped on the processing tray 27 through the sheet discharging port 30 and conveys the tailing end of the sheet toward the regulating member 32. The friction rotor 34 is structured with a rise-fall roller axially supported by a flexible belt (a timing belt, a ring-shaped belt) or an arm member (bracket) that swings upward and downward to be moved upward and downward in accordance with a height position of sheets stacked on the processing tray 27. In the present embodiment, the friction rotor 34 is connected to the sheet discharging roller 31*a* via a flexible belt and is rotated with drive force of the above-mentioned conveying motor.

<Aligning Mechanism>

The aligning mechanism 60 that aligns a sheet is arranged at the processing tray 27. As illustrated in FIGS. 3 and 4A to 4C, the aligning mechanism 60 includes a regulating member 32 that regulates one end of a sheet conveyed to the processing tray 27 in the sheet conveying direction (the tailing end in the present embodiment), an aligning member 36 (a front aligning member 36*a*, a rear aligning member 36*b*) that aligns the sheet whose one end in the sheet conveying direction is regulated by the regulating member 32 while pressing the sheet in a direction perpendicular to the sheet conveying direction, a drive portion that moves the aligning member 36 between an aligning position and a non-aligning position, and a third sensor Se3 (see FIG. 6) that detects shifting of a sheet from a sheet bundle aligned at the aligning position by the aligning member 36 as misalignment.

(1) Regulating Member

The regulating member 32 includes stopper pieces 32*a*, 32*b* each having an abutment regulating face arranged at the rear end of the processing tray 27. With respect to moving operation of the post-processing unit (stapling unit) 28, the regulating member 32 includes a plurality (in the present example, a pair) of the stopper pieces (the front stopper piece 32*a* and the rear stopper piece 32*b*) arranged as being distanced. Here, the front stopper piece 32*a* is arranged at the front tray and the rear stopper piece 32*b* is arranged at the rear tray.

(2) Drive Portion

Figure 4A:
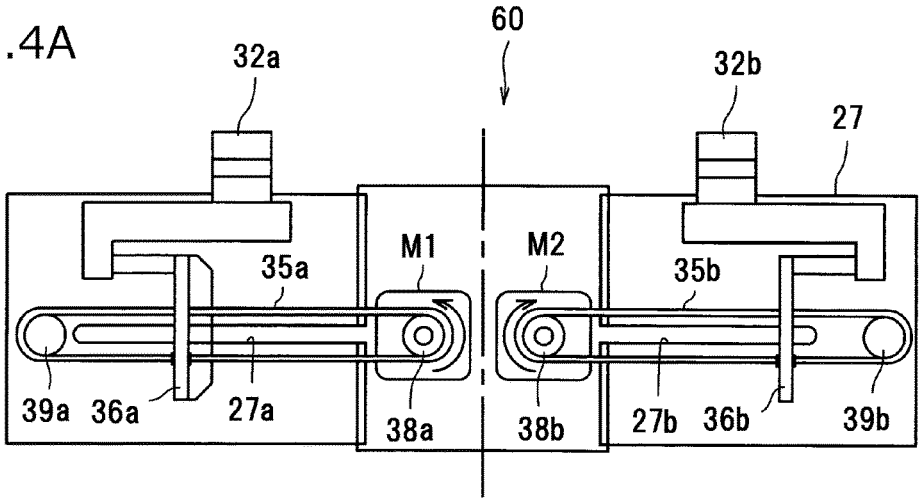

FIG. 4A is a bottom view of the aligning mechanism 60 illustrated in FIG. 3 viewing from the back face side. As illustrated in FIG. 4A, an aligning motor M1 is fixed to the center tray. A pulley 38*a* is fitted to a motor shaft of the aligning motor M1. A timing belt 35*a* is tension-routed to surround a guide groove 27*a* between the pulley 38*a* and a pulley 39*a* rotatably fixed to one side of the front tray. Meanwhile, an aligning motor M2 is fixed to the center tray as well. A pulley 38*b* is fitted to a motor shaft of the aligning motor M2. A timing belt 35*b* is tension-routed between the pulley 38*b* and a pulley 39*b* rotatably fixed to one side of the rear tray. Each of the aligning motors M1, M2 is structured with a stepping motor capable of providing positive-reverse rotation. Here, the above components are arranged in a symmetrical manner with respect to the center line of the center tray (a dot-and dash line in FIG. 4A).

(3) Aligning Member

As illustrated in FIGS. 3 and 4A, the front aligning member 36*a* and the rear aligning member 36*b* that align a sheet conveyed to the processing tray 27 (a sheet with one end (tailing end) in the sheet conveying direction regulated by the regulating member 32) while pressing in a direction (sheet width direction) perpendicular to the sheet conveying direction are fixed to the timing belts 35*a*, 35*b*, respectively. The aligning members 36*a*, 36*b* are structured with resin-made members.

Figure 4B:
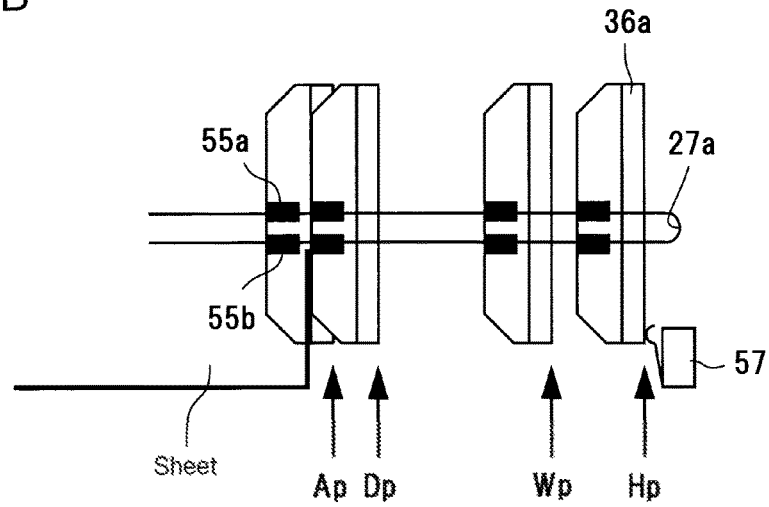
Figure 4C:
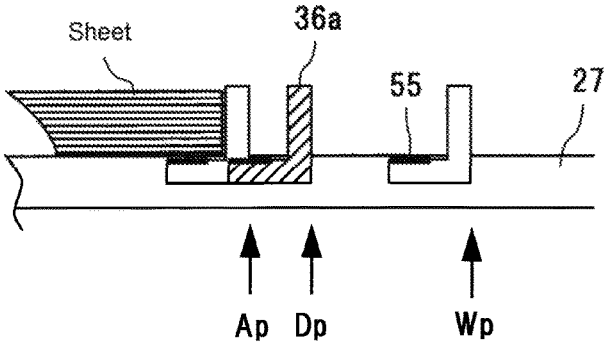

As illustrated in FIGS. 4A and 4C, the front aligning member 36*a* is formed into a shape having an L-shaped cross-section including a plate-shaped protruded portion that is protruded upward and an extended portion that is extended in the horizontal direction from a bottom part of the protruded portion. Meanwhile, as illustrated in FIG. 4A, the rear aligning member 36*b* is formed into a (plate-shaped) shape including only a protruded portion without an extended portion. The protruded portion of each of the aligning members 36*a*, 36*b* has a face facing a sheet as being in parallel to the center line of the center tray (a dot-and-dash line in FIG. 4A) as an aligning face. The aligning face is arranged to be abutted (surface-contacted) to a side edge of a sheet (bundle). In FIG. 4A, only the front aligning member 36*a* is formed into a shape having an L-shaped cross-section including the extended portion that is extended in the horizontal direction from the bottom part of the protruded portion. However, it is also possible that an extended portion is arranged at the rear aligning member 36*b* as well. Further, it is also possible to arrange an extended portion having an L-shaped cross-section at each of the front aligning member 36*a* and the rear aligning member 36*b*.

A pin-shaped member (not illustrated) is arranged at the center of a bottom face of the protruded portion of each aligning member 36*a*, 36*b*. The pin-shaped members are inserted in a slidable manner to the guide grooves 27*a*, 27*b*, respectively. Thus, the aligning member 36*a*, 36*b* is supported at two positions being the timing belt 35*a*, 35*b* and the side edge of the guide groove 27*a*, 27*b* (the front tray, the rear tray) to be movable in the sheet width direction along the guide groove 27*a*, 27*b*.

The front aligning member 36*a* is configured to be movable with the drive portion (aligning motor M1) between the aligning position where a sheet is pressed and aligned (to be exact, the aligning face is abutted to a sheet side edge) and the non-aligning position. That is, as illustrated in FIG. 4B, the front aligning member 36*a* is configured to be movable among an aligning position Ap, a sheet shift detecting position (hereinafter, called a detecting portion) Dp for detecting shifting of a sheet from a sheet bundle aligned at the aligning position as misalignment, a sheet receiving position (hereinafter, called a receiving position) Wp for receiving a sheet to be conveyed to the processing tray 27, and a home position Hp defined in an initial setting process serving as a reference for pulse outputting. Here, a limit sensor 57 that detects whether the aligning member 36*a*, 36*b* is located at the home position Hp at the time of executing the initial setting process is arranged at each of the front tray and the rear tray.

As is clear from FIG. 4B, the detecting position Dp, the receiving position Wp, and the home position Hp are defined to be apart from the sheet side edge in the order thereof with respect to the aligning position Ap where the aligning face is abutted to the sheet side edge. The receiving position Wp is defined in addition to the home position Hp to reduce movement distance of the aligning member 36 (to shorten processing time of the aligning process). Here, the aligning motor M1 is positively driven to move the front aligning member 36*a* from the non-aligning position (e.g., the receiving position Wp) to the aligning position Ap. In contrast, the aligning motor M1 is reversely driven to move the front aligning member 36*a* from the aligning position Ap to the non-aligning position (e.g., the detecting position Dp).

Meanwhile, the rear aligning member 36*b* is configured to be movable with the drive portion (aligning motor M2) between the aligning position and the non-aligning position, that is, among the aligning position Ap, the receiving position Wp, and the home position Hp. The rear aligning member 36*b* is different from the front aligning member 36*a* in a point of being incapable of being positioned to the detecting position Dp.

In the present embodiment, the aligning position Ap, the receiving position Wp, and the home position Hp are defined in center reference, that is, with reference to the center line of the center tray (i.e., the sheet center). That is, distances from the center line of the center tray to the aligning position Ap, the receiving position Wp, and the home position Hp of the front aligning member 36*a* are defined to be the same as distances from the center line of the center tray to the aligning position Ap, the receiving position Wp, and the home position Hp of the rear aligning member 36*b*, respectively. In the present embodiment, although the aligning position Ap, the detecting position Dp, and the receiving position Wp are defined in accordance with sheets having different width sizes, positional relation between the aligning position Ap and the detecting position Dp is not varied in accordance with the sheet width size.

(4) Third Sensor

The third sensor Se3 is fixed to the front aligning member 36*a*. Such a sensor is not arranged at the rear aligning member 36*b*. Accordingly, the rear aligning member 36*b* does not include an extended portion and does not move to the detecting position. A flat type electrostatic capacitance sensor of an electrode separation type (to be exact, an electrostatic capacitance type proximity sensor) is used as the third sensor Se3. FIGS. 4B and 4C illustrate an example that electrode members 55*a*. 55*b* of the third sensor Se3 are attached on an upper face of the extended portion of the front aligning member 36*a*.

Figure 6:
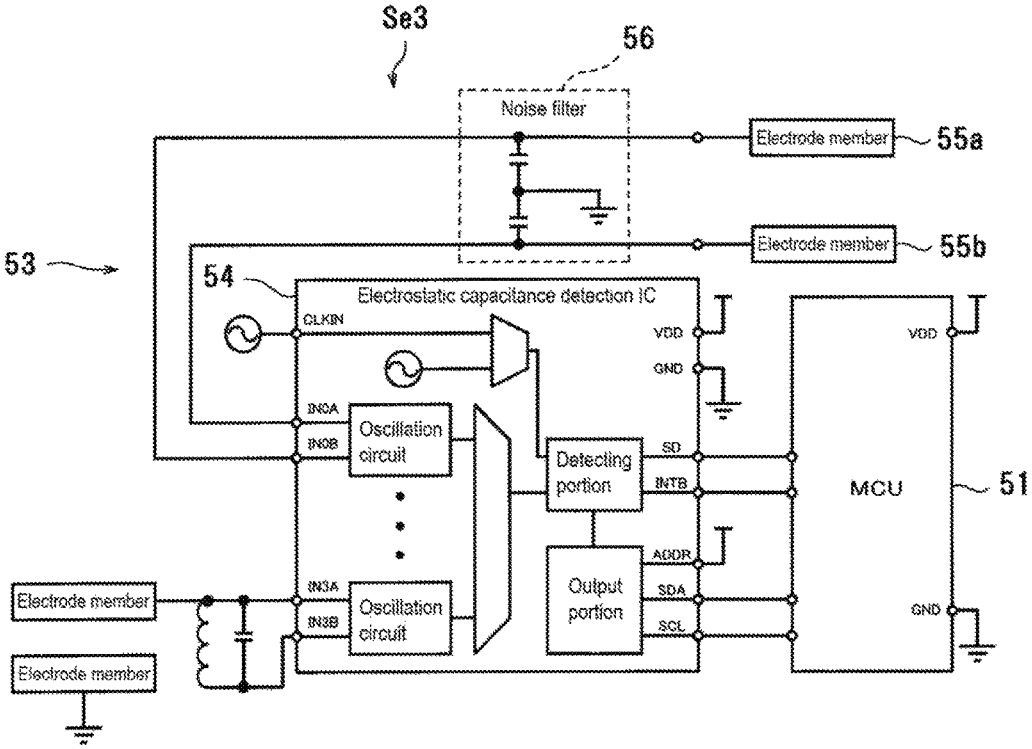
FIG. 6 is a block circuit diagram of a third sensor.

FIG. 6 is a block circuit diagram of the third sensor Se3 that is structured with an electrostatic capacitance sensor. Such an electrostatic capacitance sensor is a sensor that detects variation of electrostatic capacitance between electrodes when an object approaches the electrodes (in the present embodiment, when a sheet is shifted from a sheet bundle). Details thereof will be described in the following.

The third sensor Se3 includes the electrode members 55*a*, 55*b* (hereinafter, called the electrode member 55 when called collectively) and a sensor control portion 53. In the present embodiment, the electrode member 55 is formed as a copper foil tape obtained by providing adhesive on one face of copper foil and is connected to the sensor control portion 53 through a conductive harness (lead wire).

The sensor control portion 53 includes a noise filter 56 that eliminates noise superimposed on the harness and an electrostatic capacitance detection IC 54 that detects variation of electrostatic capacitance between the electrode members 55*a*, 55*b*. The noise filter 56 and the electrostatic capacitance detection IC 54 are mounted on a single flexible substance. In the present embodiment, the flexible substance is attached with double-stick tape to a face opposite to the aligning face of the front aligning member 36*a*. Accordingly, the third sensor Se3 is configured to be movable along with the front aligning member 36*a*.

The electrostatic capacitance detection IC 54 includes an oscillation circuit, a detecting portion, and an output portion. The oscillation circuit is a high frequency CR oscillation type and is connected to the electrode members 55*a*, 55*b* through the noise filter 56. The oscillation circuit is configured so that the electrostatic capacitance between the electrode members 55 serves as an element of oscillation conditions. Based on variation of the electrostatic capacitance (voltage value) between the electrode members 55 caused by a sheet shifted from a sheet bundle in a case of misalignment, the detecting portion detects the electrostatic capacitance between the electrode members 55. The output portion outputs the detected value to an MCU 51 through serial communication in accordance with instructions of the MCU 51 described later. Examples of such serial communication include an $I^2C$ communication type.

The present embodiment includes two structural lines prepared by coupling the electrode members 55*a*, 55*b* using capacitors and ground and each of the structural lines is connected to the electrostatic capacitance detection IC 54. The electrostatic capacitance detection IC 54 transmits pulsed voltage through one side and detects the electrostatic capacitance (voltage value) occurring with respect to the other side from the side through which the pulsed voltage is not transmitted.

The electrostatic capacitance detection IC 54 has a detection strength control function and an adjustment function. As the detection strength control function, it is possible to change a detection range of an object by changing strength of an electric field to be generated between the electrode members 55*a*, 55*b*. As the adjustment function, it is possible that a value detected under the circumstances at the time of performing adjustment is set to be an initial value.

For example, X represents a detection value that is detected by the third sensor Se3 when adjustment is performed in a condition that any object does not exist therearound. When a sheet is placed on the third sensor Se3 thereafter, the detection value is decreased from X by Y to be (X−Y). Further, when adjustment is performed in the state with the sheet placed, the detection value is initialized to X. When the sheet is removed from this state, the detection value is increased by Y being the value decreased in the above to be (X+Y).

Figure 5:
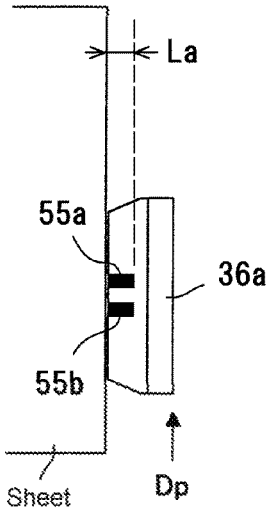
FIG. 5 is a plane view schematically illustrating arrangement of electrode members of the front aligning member.

The electrostatic capacitance sensor has characteristics that detection value becomes large with increase of a ratio of area overlapping with a sheet to total area of the conductive members 55*a*, 55*b*. As illustrated in FIG. 4B, the conductive members 55*a*, 55*b* are attached to the front aligning member 36*a* in parallel to a direction perpendicular to the sheet conveying direction. Further, as illustrated in FIG. 5, when being positioned at the detecting position Dp, the front aligning member 36*a* is positioned in the vicinity of the sheet bundle side edge so that end parts of the conductive members 55*a*, 55*b* on the sheet bundle side do not overlap with the sheet bundle. On the contrary, the front aligning member 36*a* is positioned so that a sheet shifted from a sheet bundle overlaps with the conductive members 55*a*, 55*b* when misalignment occurs.

To detect occurrence of misalignment from the characteristics of the electrostatic capacitance sensor, it is preferable that a sheet shifted from a sheet bundle overlaps with a half or more of the entire conductive members 55*a*, 55*b*. As illustrated in FIG. 5, it is simply required that length La of the conductive members 55*a*, 55*b* in the longitudinal direction is set to about two times of the allowable maximum sheet shifting value. With such arrangement, even when a shifted sheet slightly overlaps with end parts of the conductive members 55*a*, 55*b*, the detection value shows little change. Accordingly, detection error of misalignment does not occur, for example, even when small tolerance exists with the detecting position Dp owing to assembling tolerance and the like. When misalignment exceeds the allowable range, the overlapping occurs with a half or more of the conductive members 55*a*, 55*b* and it is reliably determined to be misalignment.

Further, it is required to take into account influence to be caused by increase of the number of sheets stacked on the processing tray 27. With the third sensor Se3, the detection value is changed owing to that a sheet shifted from a sheet bundle blocks an electric field generated between the conductive members 55*a*, 55*b*. At this time, variation of the detection value becomes large with increase of blocking the electric field. Since the electric field is extended spatially, even when a sheet does not overlap directly on the conductive members 55*a*, 55*b*, the detection value is changed when the sheet exists as being close to the edge of the conductive members 55*a*, 55*b*.

According to such characteristics, owing to that the electric field between the conductive members 55*a*, 55*b* is blocked more by a sheet bundle side face with increase of the number of stacked sheets, the detection value is gradually decreased even when misalignment does not occur. Further, since the electric field is stronger as being closer to the conductive members 55*a*, 55*b*, the variation amount becomes small with increase of the number of stacked sheets causing a shifting position from a sheet bundle to be far from the conductive members 55*a*, 55*b*. Owing to the detection strength control function to control detection strength to be capable of sufficiently obtaining detection value variation caused by a sheet shifted even at height of an upper face of a sheet bundle having the maximum number of sheets stacked, the electrostatic capacitance detection IC 54 detects occurrence of misalignment even for the last sheet. That is, the detection strength is controlled to be enhanced in accordance with increase of the number of stacked sheets.

<Post-Processing Unit>

The post-processing unit 28 illustrated in FIG. 2 is structured with a stapling unit that performs a binding process on a sheet bundle stacked on the processing tray 27. Alternatively, the post-processing unit 28 is structured with a punching device, a stamping device, or the like. Accordingly, the processing tray 27 is not limited to have a structure to collate and stack sheets fed through the sheet discharging port 30 into a bundle shape (as in a case that the post-processing unit is a stapling unit). The processing tray 27 may be structured to perform a post-process one by one on sheets fed through the sheet discharging port 30 (as in a case that the post-processing unit is a stamping unit). In the present embodiment, since the post-processing unit 28 is arranged on one side of the processing tray 27, the post-processing unit 28 has a slope being downward to the right as being similar to the processing tray 27.

<Stack Tray>

The stack tray 29 is structured with a rise-fall tray. The stack tray 29 is configured to be capable of being adjusted in height by the lifting-lowering mechanism so that the uppermost stacked sheet is located approximately on the same plane as a sheet supported on the processing tray 27.

<Control Portion>

Further, the post-processing apparatus B includes a control portion (hereinafter, called a post-processing control portion for discriminating from the main body control portion 40) 50 that entirely controls the post-processing apparatus B. As illustrated in FIG. 7, the post-processing control portion 50 includes an MCU 51 that incorporates a CPU, a ROM, a RAM, and the like. The MCU 51 is connected to an actuator control portion 52. The actuator control portion 52 is connected to a variety of actuators such as motors being the conveying motor, the aligning motor and the like and plungers. Further, the MCU 51 is connected to the sensors being Se1 to Se3 and the like.

The MCU 51 of the post-process control portion 50 communicates with the MCU 51 of the main body control portion 40 so as to receive, from the MCU 51, information necessary for performing control by the post-processing apparatus B such as post-process mode information, sheet size information, and job completion information.

(Operation)

Next, description of operation of the image forming system of the present embodiment will be provided mainly on the MCU 41 of the main body control portion 40 and the MCU 51 of the post-process control portion 50. Since individual operation of each structural member is described above, brief description will be provided on a case, as an example, that an operator specifies a staple process as a post-process mode via a touch panel. Then, detailed description will be provided on an aligning process (control of the aligning mechanism 60 by the MCU 51) that is one of the features of the present invention.

[General Operation]

<Image Forming Apparatus>

When a start button on the touch panel is depressed by an operator, the MCU 41 reads information input via the touch panel through a touch panel control portion 44 and causes the image reading portion 5 through the image reading control portion 45 to read a document. Further, through the sheet feeding control portion 43, a pick-up roller 2*x* of the sheet feeding cassette desired by the operator is rotated to feed a sheet and the conveying roller on the sheet feeding path 6 is driven. Accordingly, the fed sheet is conveyed on the sheet feeding path 6 toward the resist roller 7.

A sensor is provided on the upstream side of the resist roller 7. After the sensor detects a leading end of a conveyed sheet, the resist roller 7 is kept in a rotationally-stopped state for a predetermined time. Accordingly, aligning at a leading end of the sheet is performed.

After elapse of the predetermined time, the MCU 41 causes the resist roller 7 and other conveying rollers to be rotationally driven and causes, through the image forming control portion 42, respective portions that structure the image forming portion 3 to be operated so that an image is formed on a sheet and the sheet is discharged from the sheet discharging port 13 through the sheet discharging path 15. In advance of operation of the image forming portion 3, the MCU 41 obtains image information of a document as causing the document feeding device 19 and the document reading device 5 to be operated in accordance with instruction of the operator and controls the image forming control portion 42 so that an image is formed on the sheet by the image forming portion 3 in accordance with the obtained image information.

<Post-Processing Apparatus>

In advance of post-processing by the post-processing apparatus B, the MCU 51 receives post-process mode information and sheet size information from the MCU 41. When the above information is received from the MCU 41, the MCU 51 drives, through the actuator control portion 52, conveying motors that rotate the introducing roller 22, the conveying roller 23, and the sheet discharging roller 31 arranged on the sheet conveying path 26. Further, the MCU 51 determines whether or not a sheet is introduced into the sheet conveying path 26 through the introducing port 25 by monitoring output from the first sensor Se1.

Here, in a case that a punching process is included in the post-process mode information, after the conveying motor is driven for a predetermined number of steps from the timing when the first sensor Se1 detects a sheet, driving of the conveying motor is stopped. Accordingly, the sheet is sandwiched by the introducing roller 22 and the conveying roller 23 and a punching process is performed by the punch unit 28*p*. After the punching process is performed (after elapse of a predetermined time), the MCU 51 causes the conveying motor to be driven again to convey the sheet on the sheet conveying path 26 toward the downstream side.

Further, when the post-process mode information and the sheet size information are received, the MCU 51 causes the reversing roller 33 to wait at the waiting portion and monitors output from the second sensor Se2. Here, the reversing roller 33 is kept waiting at the waiting position in a state that a sheet is discharged through the sheet discharging port 30. After a leading end of a sheet passes, the reversing roller 33 is pressure-contacted thereto and rotated in the sheet discharging direction. Thereafter, at the timing when a tailing end of the sheet passes through the second sensor Se2, the rotational direction of the reversing roller 33 is reversed. The above control is executed, so that vertical movement of the reversing roller 33 is controlled by a lifting-lowering motor and positive-reverse rotation thereof is controlled by a roller drive motor.

Further, based on monitoring output of the first sensor Se1 and the second sensor Se2, the MCU 51 causes a sheet to be introduced onto the processing tray 27. After elapse of an estimated time for a tailing end of the sheet to arrive at the regulating member 32, the MCU 51 causes the conveyed sheet to be aligned as being pressed in a direction (sheet width direction) perpendicular to the sheet conveying direction by controlling the aligning mechanism 60. Details of the above will be described later (see the aligning process below).

When the MCU 51 receives a job completion signal from the MCU 41, the last sheet on which the job is performed is then introduced to the processing tray 27 through the sheet conveying path 26 and sheets are aligned in the width direction by controlling the aligning mechanism 60. Then, the MCU 51 drives a drive motor of the post-processing unit (stapling unit) 28 through the actuator control portion 52. Thus, the post-processing unit 28 performs a binding process.

Thereafter, the MCU 51 causes a sheet bundle on the processing tray 27 to be pressure-contacted by the reversing roller 33 through the actuator control portion 52 and causes the reversing roller 33 to be rotated in a direction toward the stack tray 29. With such operation, the sheet bundle on the processing tray 27 is stored on the stack tray 29 at the downstream side.

[Aligning Process]

<Relation with Sensor Se1>

At the time when the MCU 51 receives the post-process mode information and sheet size information from the MCU 41, the aligning member 36 is positioned at the home position Hp as being positioned with the initial setting process or the receiving position at the time of the last job completion. When the post-process mode information and the sheet size information are received, the MCU 51 perceives the numbers of drive pulses of the aligning motors M1, M2 for moving the aligning mechanism 60 in accordance with the sheet size among the home position Hp, the receiving position Wp, the detecting position Dp, and the aligning position Ap by referring a table expanded in the RAM, and determines whether or not the first sensor Se1 detects a sheet leading end.

When the first sensor Se1 detects a leading end of the first sheet of a current job, the MCU 51 drives the aligning motors M1, M2 via the actuator control portion 52 to cause the aligning member 36 to move from the home position Hp or the receiving position Wp at the time of the last job completion to the receiving position Wp of the current job.

Further, after the post-process mode information and the sheet size information are received, the MCU 51 counts the number of sheets every time when a sheet leading end is detected by the first sensor Se1. When the first sensor Se1 detects the sheet leading end after the MCU 51 receives a job completion signal from the MCU 41, the MCU 51 acknowledges that the last sheet to be conveyed in the current job has been conveyed into the post-processing apparatus B. Here, such a process can be performed by monitoring the second sensor Se2 (e.g., detecting a sheet leading end).

<Basic Aligning Process>

Figure 8:
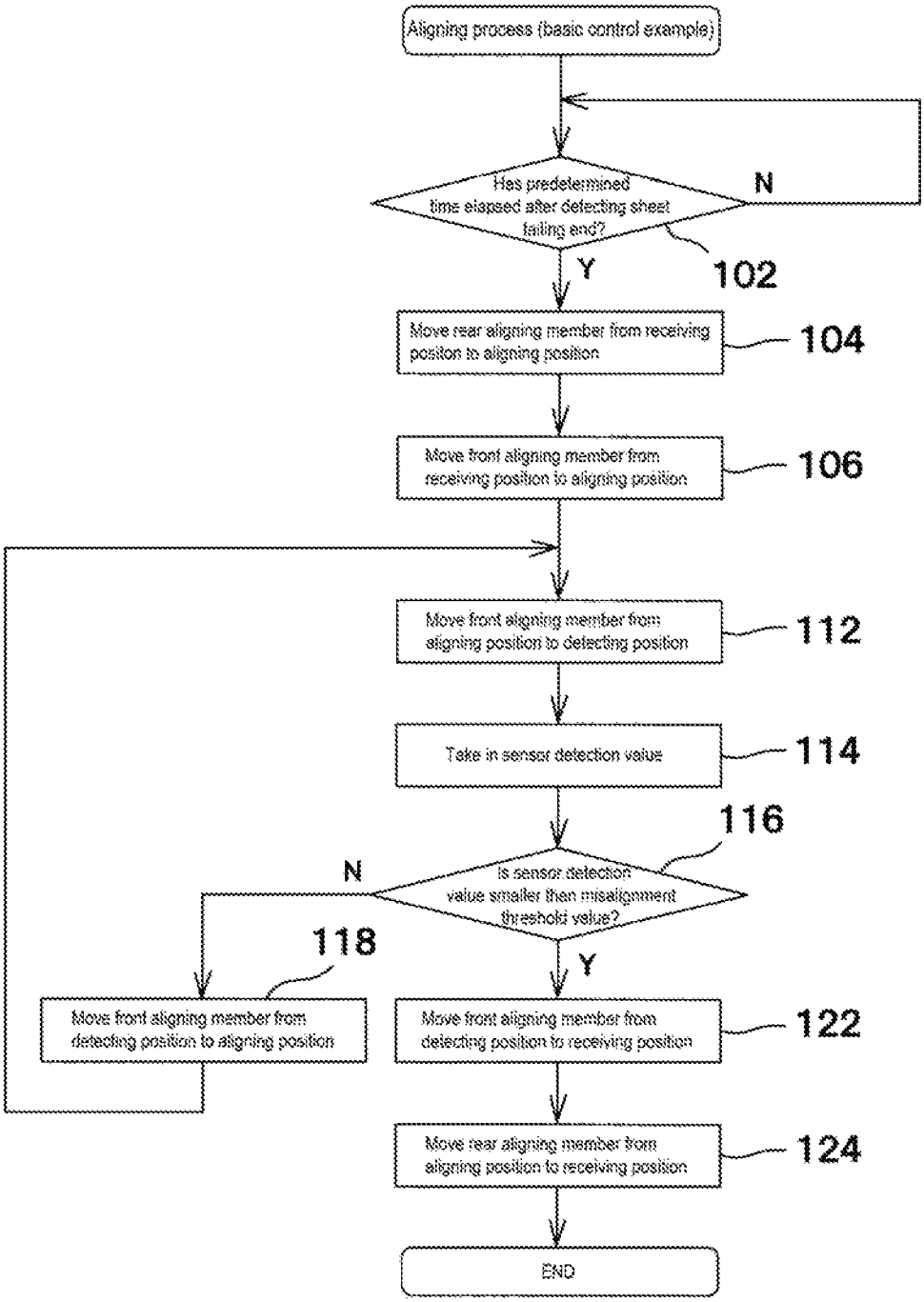
FIG. 8 is a flowchart of a basic aligning process routine that is executable by an MCU of a post-process control portion.

Next, a basic aligning process will be described with reference to a flowchart illustrated in FIG. 8. FIG. 8 illustrates the aligning process from when the second sensor Se2 detects a tailing end of a sheet conveyed on the sheet conveying path 26 until the aligning member 36 is moved to the receiving position Wp for receiving the next sheet.

As illustrated in FIG. 8, in step 102, a stand-by state continues until a predetermined time (an estimated time for the tailing end arriving at the regulating member 32 as the sheet being conveyed on the processing tray 27) elapses after the second sensor Se2 detects a sheet tailing end. When the predetermined time elapsed (when the sheet tailing end is abutted to and regulated by the regulating member 32), in step 104, the aligning motor M2 is positively driven via the actuator control portion 52 so that the rear aligning member 36*b* is moved from the receiving portion Wp to the aligning position Ap. Then, in step 106, the aligning motor M1 is positively rotated via the actuator control portion 52 so that the front aligning member 36*a* is moved from the receiving position Wp to the aligning position Ap. According to the above, the sheet conveyed to the processing tray 27 is aligned by being pressed by the aligning face of the aligning member 36 in the width direction thereof. Thus, the sheet is aligned in the width direction for the respective sides having a time gap between step 104 and step 106. This is to improve aligning characteristics even when a sheet to be conveyed is skewed.

Next, in step 112, the aligning motor M1 is reversely rotated so that the front aligning member 36*a* is moved from the aligning position Ap to the detecting position Dp. Then, in step 114, a detection value of the third sensor Se3 that is located at the detecting position Dp along with the front aligning member 36*a* is taken in. Next, in step 116, it is determined whether or not the detection value taken in in step 114 is smaller than a (predetermined) threshold value for determining misalignment (sheet shifting from a sheet bundle).

When the determination in step 116 is NO (when the detection value is equal to or larger than the threshold value), the aligning motor M1 is positively rotated so that the front aligning member 36*a* is moved again from the detection position Dp to the aligning position Ap in step 118 and the procedure returns to step 112 to perform realigning for misalignment. On the other hand, when the determination in step 116 is YES, there is no misalignment. Accordingly, in preparation for aligning the next sheet, the aligning motor M1 is reversely rotated in step 122 so that the front aligning member 36*a* is moved from the detecting position Dp to the receiving position Wp. Then, in step 124, the aligning motor M2 is reversely rotated so that the rear aligning member 36*b* is moved from the aligning position Ap to the receiving position Wp, and then, the aligning process routine for one sheet is completed.

<Aligning Process to be Performed by MCU 51>

Figure 9:
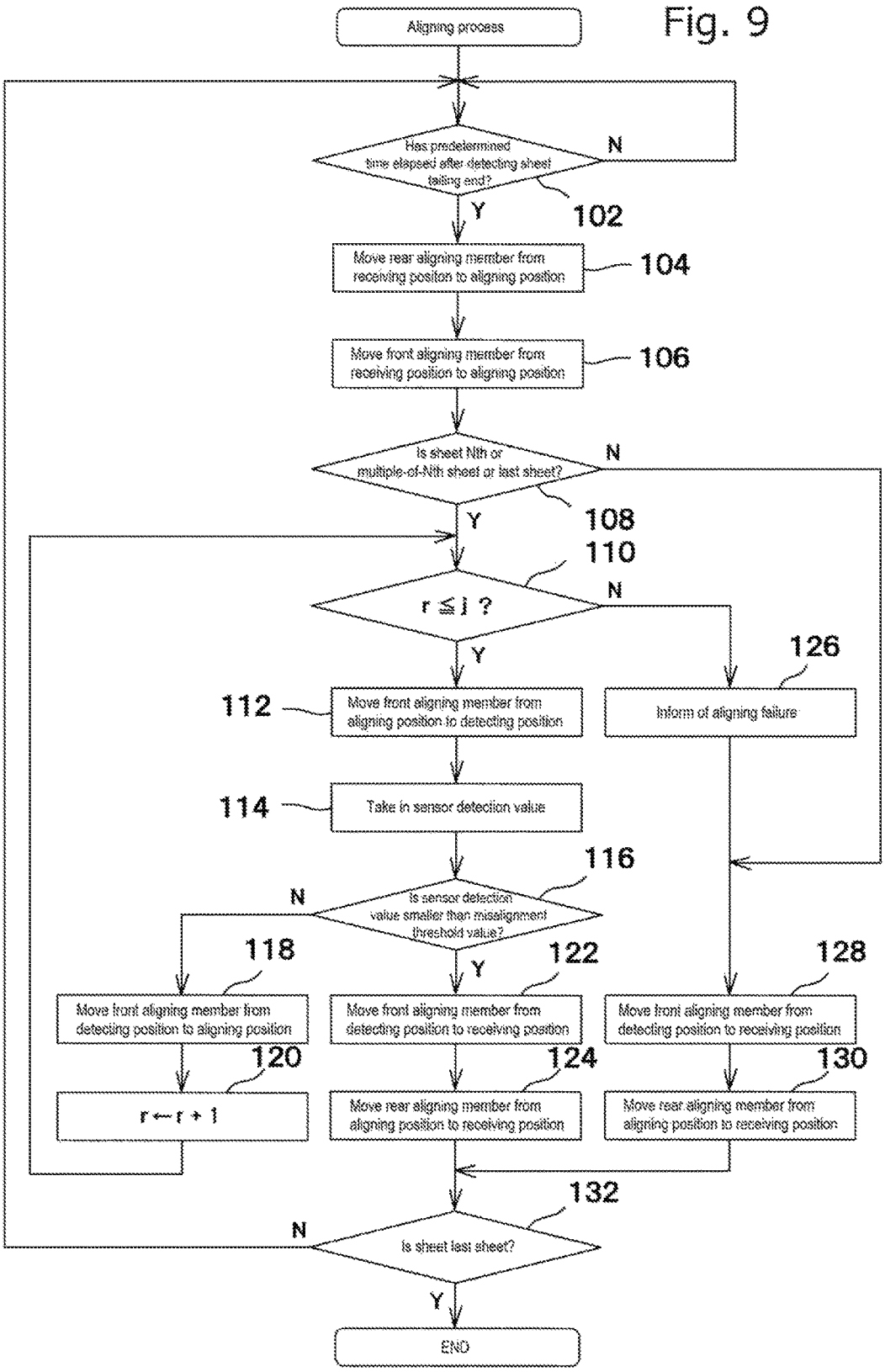
FIG. 9 is a flowchart of an aligning process routine to be executed by the MCU of the post-process control portion.

According to performing the abovementioned basic aligning process, it is possible to form a sheet bundle without having misalignment. Based on the basic aligning process, the MCU 51 further executes an aligning process routine illustrated in FIG. 9. Conditions described below are added to the aligning process routine illustrated in FIG. 9 for performing detecting and correcting of misalignment. Here, FIG. 9 illustrates the aligning process routine for one job.

(1) Detecting of misalignment is not performed for a sheet that is not an Nth or multiple-of-Nth sheet. That is, detecting of misalignment is performed every multiple-of-Nth sheets. Here, N is a natural number (e.g., three).

(2) Irrespective of the above condition (1), detecting of misalignment is performed for the last sheet.

(3) The number of aligning times for one sheet (maximum number of repetition times) is limited to j (being a natural number, e.g., two).

In the following, description will be provided on the aligning process routine to be executed by the MCU 51. Here, for simplifying description, the same reference is provided to the same step as that described in FIG. 8 to skip description thereof and only different steps will be described.

In step 108 subsequent to step 106, it is determined whether or not a sheet being conveyed to the processing tray 27 is an Nth or multiple-of-Nth sheet or the last sheet in the current job. The procedure proceeds to step 128 when the determination is NO, and the procedure proceeds to step 110 when the determination is YES. The determination in step 108 and processes thereafter are performed in consideration of processing capacity of the post-processing apparatus B. Owing to that the above conditions are set based on intervals of sheet conveying, the aligning operation can be performed without lowering the processing capacity.

In step 110 subsequent to step 108, it is determined whether or not the number of repetition times r is equal to or smaller than the predetermined maximum number of repetition times j. When the determination is YES, the procedure proceeds to step 112. When the determination is NO, the procedure proceeds to step 126 and the MCU 41 is informed of that the aligning has failed. Owing to that the determination is performed in step 110, the aligning operation is prevented from being eternally performed, for example, in a case that a sheet of a size being larger than sheets stacked on the processing tray 27 is mixed. Further, the information provided in step 126 can be used for determining for mixing of a sheet of a different size or discharging timing of the next sheet. The MCU 41 having received the information may cause the touch panel to display the information via the touch panel control portion 44.

In step 128 subsequent to step 126, the aligning motor M1 is reversely rotated so that the front aligning member 36*a* is moved from the aligning position Ap to the receiving position Wp in preparation for aligning the next sheet. In step 130, the aligning motor M2 is reversely rotated so that the rear aligning member 36*b* is moved from the aligning position Ap to the receiving position Wp, and then, the procedure proceeds to step 132. After the process in step 124, the procedure proceeds to step 132 as well. In step 120 subsequent to step 118, the number of repetition times r is incremented by one and the procedure returns to step 110. In step 132, it is determined whether or not a sheet is the last sheet. When the determination is YES, the aligning process routine is completed. When the determination is NO, the procedure returns to step 102 for processing for the next sheet.

(Effects and the Like)

Next, description will be provided on effects and the like of the image forming system of the present embodiment mainly on the aligning mechanism 60 and the control portion 50 (MCU 51) of the post-processing apparatus B.

In the image forming system of the present embodiment, the control portion 50 (MCU 51) causes the aligning members 36*a*, 36*b* to be moved to the aligning position Ap to align sheets conveyed to the processing tray 27 (steps 104 and 106), and then, causes the aligning member 36*a* to be moved from the aligning position Ap to the detecting position Dp (step 112). Subsequently, it is determined whether or not the third sensor Se3 detects misalignment (shifting of a sheet from a sheet bundle) (steps 114 and 116). When it is determined that the third sensor Se3 detects misalignment (step 116), the aligning member 36*a* is moved from the detecting position Dp to the aligning position Ap so that sheets are realigned (step 118). Thus, according to the image forming system of the present embodiment, misalignment is detected and corrected. Further, since misalignment is corrected by the aligning member 36*a* that is positioned at the detecting position Dp being closer to the sheet end edge than the receiving position Wp (see FIGS. 4B, and 4C), movement distance of the aligning member 36*a* can be reduced. Accordingly, it is possible to reduce time required for correcting misalignment.

The present embodiment exemplifies a case that both sides of sheets in the width direction are to be aligned. However, not limited thereto, it is also possible that aligning is performed only on one side. Further, the present embodiment exemplifies a case that the sensor (third sensor Se3) that detects misalignment is arranged only at the front aligning member 36*a*. However, it is also possible to detect and correct misalignment on both sides of sheets in the width direction while the rear aligning member 36*b* is formed into a similar shape as the front aligning member 36*a* and a sensor that detects misalignment is arranged at the rear aligning member 36*b* as well. In this case, reliability of alignment can be further improved. Further, the present embodiment exemplifies a case that aligning is performed in center reference. However, the present invention is not limited thereto. For example, it is also possible to perform aligning in side reference in which a side edge of sheets is used as reference.

Further, the present embodiment exemplifies a case that the third sensor Se3 is moved along with the front aligning member 36*a*. However, the present invention is not limited thereto. It is also possible that the third sensor Se3 is fixed, for example, (to a member arranged) above the processing tray 27. Such a case is suitable for limited sheet sizes. Here, a plurality of sensors may be arranged in accordance with sheet sizes. Further, such a case is applicable to an apparatus that performs an offset process, for example on the stack tray 29.

Further, the present embodiment exemplifies a case that the flexible substrate structuring the third sensor Se3 is attached to the front aligning member 36*a*. However, the present invention is not limited thereto. For example, the third sensor Se3 may be fixed to the front tray. It is simply required that at least the electrode member 55 of the third sensor Se3 is arranged at the front aligning member 36*a*.

Further, although it is not described in the present embodiment, it is also possible to apply the adjustment function of the electrostatic capacitance detection IC 54 as follows. Adjusting is performed in a state that misalignment does not occur for every predetermined number (N as described above) of sheets and a detection value at that time is defined as an initial value. In this case, it is possible to detect the same degree of values continuously in a state that misalignment does not occur even when the number of sheets stacked is increased. Accordingly, it is possible to determine that misalignment occurs when a variation amount of detection values in misalignment detection becomes larger than a threshold value that is defined as a difference between a detection value in a case without misalignment occurrence at stack height with the maximum number of sheets and a detection value in a case with misalignment occurrence being the minimum variation amount.

Further, the present embodiment exemplifies a case that the alignment faces of the alignment members 36*a*, 36*b* are formed of plate-shaped members. It is also possible that resin-made elastic members are arranged on the alignment faces or the aligning faces are formed of elastic springs or the like. According to such a structure, it is possible to reduce damage on sheets to be caused by the aligning process.

Further, the present embodiment exemplifies two structural lines prepared by coupling the electrode members 55*a*, 55*b* using capacitors and ground. However, as illustrated in FIG. 6 at the lower-left side, it is also possible that one of the two electrode members is connected to the electrostatic capacitance detection IC 54 having a structure coupled using a capacitor to be loop-shaped and the other thereof is connected to the ground. With this structure, pulsed voltage is transmitted from the one electrode member connected to the electrostatic capacitance detection IC 54 and electrostatic capacitance is detected through the other electrode member. Here, the ground for the other electrode member may be an electrode member connected to the ground through a harness or may be a conductive apparatus frame or a conductive guide member connected to the ground.

Further, the present embodiment exemplifies a case that the second sensor Se2 is arranged at the sheet conveying path 26 and detects a sheet to be conveyed to the processing tray 27. However, the present invention is not limited thereto. For example, it is also possible that the second sensor Se2 detects a dropping sheet or detects a sheet conveyed to the processing tray 27 as being arranged on the sheet processing tray 27 side. Such a structure is suitable for a sheet aligning apparatus that is built in a variety of apparatuses.

Further, the present embodiment exemplifies a case that the rear aligning member 36*b* and the front aligning member 36*a* are to be located at the aligning position Ap in the order thereof for skew correcting (steps 104 and 106). However, it is also possible that step 106 is executed before executing step 104. Further, the present embodiment exemplifies a case that the front aligning member 36*a* and the rear aligning member 36*b* are located at the receiving position Wp in the order thereof for receiving the next sheet after sheet aligning. However, it is also possible that step 124 is executed before executing step 122 or steps 122 and 124 are executed concurrently. Steps 128 and 130 are the same as the above.

INDUSTRIAL APPLICABILITY

As described above, the present invention contributes to manufacturing and selling of sheet aligning apparatuses, image forming systems, and sheet post-processing apparatuses by providing sheet aligning apparatuses, image forming systems, and sheet post-processing apparatuses capable of detecting misalignment. Accordingly, the present invention has industrial applicability.

This application claims the benefit of Japanese Patent Application No. 2015-233319 which is incorporated herein by reference.

What is claimed is:

1. A sheet aligning apparatus, comprising:

a sheet stack portion on which a sheet is to be stacked;

a pair of aligning members that includes an aligning portion protruding upwardly from the sheet stack portion and that is configured to press a sheet conveyed to the sheet stack portion in a direction perpendicular to a sheet conveying direction and to align the sheet at an aligning position, with the aligning portion;

a moving device that is configured to move the pair of aligning members between the aligning position and a non-aligning position; and a detecting device that is configured to detect shifting of a sheet from a sheet bundle, at the aligning position, aligned as misalignment.

2. The sheet aligning apparatus according to claim 1, further comprising a control portion that is configured to control the moving device so that the pair of aligning members is located at the aligning position when the misalignment is detected by the detecting device.

3. The sheet aligning apparatus according to claim 1, wherein the detecting device is attached to at least one of the pair of aligning members and configured to be moved along with the pair of aligning members.

4. The sheet aligning apparatus according to claim 3, wherein the moving device is configured to move the pair of aligning members between the aligning position and a detecting position where the misalignment is to be detected, and the detecting device is configured to detect the misalignment when the pair of aligning members is located at the detecting position.

5. The sheet aligning apparatus according to claim 4, wherein the control portion controls the moving device so as to cause the pair of aligning members to be moved to the aligning position and align a sheet conveyed to the sheet stack portion, and then, to cause the pair of aligning members to be moved from the aligning position to the detecting position, and the control portion controls the moving device so as to cause, when the detecting device detects the misalignment, the pair of aligning members to be moved from the detecting position to the aligning position and realign the sheet, and then, to cause the pair of aligning members to be moved from the aligning position to the detecting position to repeat detecting the misalignment by the detecting device.

6. The sheet aligning apparatus according to claim 1, wherein the detecting device is an electrostatic capacitance sensor, and at least an electrode member of the electrostatic capacitance sensor is arranged at the at least one of the pair of aligning members.

7. The sheet aligning apparatus according to claim 1, wherein the detecting device detects the misalignment if the misalignment is caused at the aligning position when the pair of the aligning members aligns the sheet.

8. An image forming system, comprising:

an image forming portion configured to form an image on a sheet;

a sheet stack portion on which the sheet with the image formed by the image forming portion is to be stacked;

a pair of aligning members that includes an aligning portion protruding upwardly from the sheet stack portion and that is configured to press a sheet conveyed to the sheet stack portion in a direction perpendicular to a sheet conveying direction and to align the sheet at an aligning position, with the aligning portion;

a moving device that is configured to move the pair of aligning members between the aligning position and a non-aligning position; and a detecting device that is configured to detect shifting of a sheet from a sheet bundle, at the aligning position, aligned as misalignment.

9. The image forming system according to claim 8, further comprising a control portion that is configured to control the moving device so that the pair of aligning members is located at the aligning position when the misalignment is detected by the detecting device.

10. The image forming system according to claim 8, wherein the detecting device detects the misalignment if the misalignment is caused at the aligning position when the aligning member aligns the sheet.

11. A sheet post-processing apparatus, comprising:

a sheet stack portion on which a sheet is to be stacked;

a pair of aligning members that includes an aligning portion protruding upwardly from the sheet stack portion and that is configured to press a sheet conveyed to the sheet stack portion in a direction perpendicular to a sheet conveying direction and to align the sheet at an aligning position, with the aligning portion;

a moving device that is configured to move the pair of aligning members between the aligning position and a non-aligning position; and a detecting device that is configured to detect shifting of a sheet from a sheet bundle, at the aligning position, aligned as misalignment.

12. The sheet post-processing apparatus according to claim 11, further comprising:

a control portion that is configured to control the moving device so that the pair of aligning members is located at the aligning position when the misalignment is detected by the detecting device, and a post-processing portion that is configured to perform a post-process on the sheet or a sheet bundle.

13. The sheet post-processing apparatus according to claim 11 wherein the detecting device detects the misalignment if the misalignment is caused at the aligning position when the aligning member aligns the sheet.

* * * * *